US005178338A

United States Patent [19]

Zakheim et al.

[11] Patent Number: 5,178,338

[45] Date of Patent: Jan. 12, 1993

[54] PROCESS AND APPARATUS FOR MAGNETIC MEDIA MILLING

[76] Inventors: Howard Zakheim, 36 W. Levering Mill Rd., Bala Cynwyd, Pa. 19004; James D. Goldschneider, 26 Beagle Club Way, Newark, Del. 19711; Markus Zahn, 17 Somerset Rd., Lexington, Mass. 02173; Charles L. Hoffmeyer, 2415 Cacia Dr., Wilmington, Del. 19810

[21] Appl. No.: 692,653

[22] Filed: Apr. 29, 1991

[51] Int. Cl.[5] ..... B20C 17/16

[52] U.S. Cl. ..... 241/172

[58] Field of Search ..... 241/65, 172, 66, 67, 241/184, 179, 171, 30; 366/273, 274

[56] References Cited

U.S. PATENT DOCUMENTS 4,856,717 8/1989 Kamiwano et al. ..... 241/172
5,022,592 6/1991 Zakheim et al. ..... 241/184 X

FOREIGN PATENT DOCUMENTS 1066644 1/1984 U.S.S.R. ..... 241/172

*Primary Examiner*—Paul A. Bell
*Attorney, Agent, or Firm*—Chris P. Konkol

[57] ABSTRACT

Media mill (1) having a magnetic circuit of magnetic impellers (11) on a shaft (12), magnetized media, and a magnetizable outer shell (10) which provides improved efficiency. The impellers (43) are magnetized by being sandwiched between at least two permanent magnets (45) in or on the shaft (42), which magnets have the same polar charge facing each other.

16 Claims, 7 Drawing Sheets

PROCESS AND APPARATUS FOR MAGNETIC MEDIA MILLING

BACKGROUND OF THE INVENTION

Media mills have long been used in the milling of pigments for finishes. Such mills can be used to grind such materials, but more typically, act to deagglomerate or disperse the material in a carrier.

A media mill typically comprises a container housing a particulate grinding media and a rotatable agitator. The agitator generally has a central shaft onto which are mounted discs or projections which aid in producing shear. The product to be milled, typically a powder in a carrier fluid, is introduced into the mill so as to flow from one end to the other. In a vertical mill, the flow is generally from bottom to top. As the product flows through the grinding media, the combination of the flow and the rotation of the agitator causes the media to become suspended or fluidized in the product. The flow difference, or shear, between the grinding media and the product deagglomerates or disperses the powder or other material being processed in the mill.

It would be desirable to improve the efficiency and/or quality of milling efficiency, for example, through reduced processing times, increased flow, or the production of finer particles.

SUMMARY OF THE INVENTION

The present invention is directed to an apparatus and process of media milling that provides faster and more efficient milling performance compared to conventional media mills. In addition, it has been found that the improved media milling may be able to achieve a finer particle dispersion of the material being reduced. For example, a finer particle size of a pigment material may result in a lesser amount thereof needed for obtaining the same quality of color in the final product. Since the time allotted for milling may be a balance between the cost or time of production and the cost of materials, the present invention may provide either improved efficiency or quality or both.

Specifically, the instant invention provides an improved process of media milling by means of a media mill comprising a magnetizable container, a rotatable multi-polar magnetic agitator within the magnetizable container, the agitator having a substantially central shaft and a plurality of magnetic impellers on the shaft, and particulate media within the container, the media present in such quantity as to provide a media volume of at least about 25%, being magnetized. The media are part of a magnetic circuit including a magnetizable outer shell and multi-polar magnetic agitator. The improvement is characterized by each of said impellers being sandwiched between at least two magnets in the central shaft. These magnets have the same polar charges facing each other, such that a magnetic charge is induced in each of the impellers, which results in the same polar charge on the top and bottom exposed faces of the impeller not in contact with the magnets. More precisely, the same polar charge is suitably present on most of the exposed faces and side edges of the impeller, although the opposite polar charge may be present, to a relatively lesser extent, in the circumferential region around where the impeller is in contact with the magnet. In terms of the exposed surface area of the impeller, the polar charge of each impeller is substantially or essentially one of either negative or positive magnetic polarity.

In a particularly preferred embodiment of the present invention, the impellers are disk shaped with chamfered or bullet shaped radial ends, in axial cross-section. Also, in the preferred embodiment, each of a plurality of impellers have a polar charge on its exposed faces that is opposite to the polar charge on the exposed faces of the two adjacent impellers, such that the impellers alternate in polar charge along the shaft. In one embodiment, there may be at least one spacer, made of a magnetizable or non-magnetizable material, between adjacent impellers, which spacer serves to moderate the strength of the magnetic charge induced in the impellers by the surrounding magnets. Alternatively, in another embodiment, a weaker magnet may be employed, in the absence of a spacer, in order that the magnetoviscosity does not become too high and generate too much heat in the mill.

BRIEF OF THE DRAWINGS

DETAILED DESCRIPTION OF THE INVENTION

Figure 1:
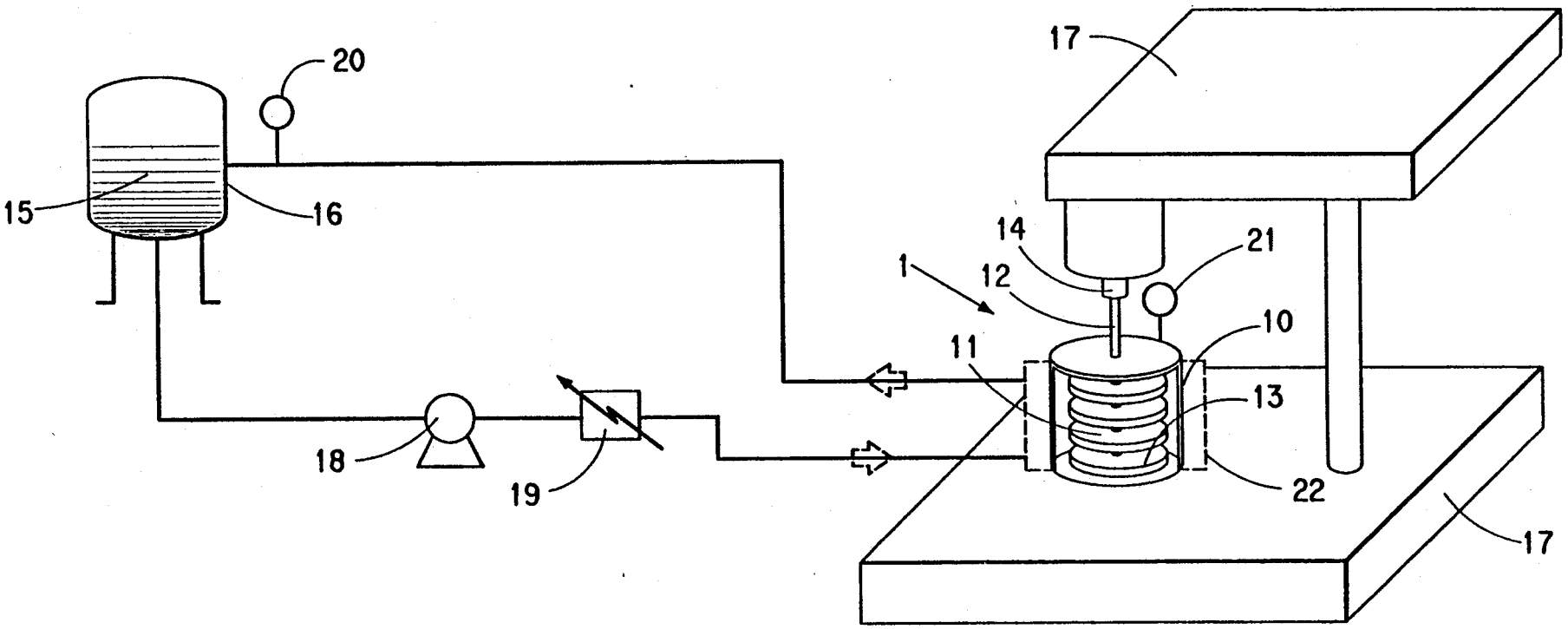
FIG. 1 is a schematic representation of a batch media mill in the present process (showing a means and cooling system).

The present invention can be more fully understood by reference to the figures, in which FIG. 1 is a schematic cross-sectional representation of one embodiment of a a magnetic media mill, generally designated 1. While the mill shown is a vertical mill, the present invention is equally applicable to horizontal mills. While the mill shown in FIG. 1 is a batch mill, the present process is equally applicable to a continuous process, as will be apparent to the skilled artisan. In a continuous process, the flow in a vertical mill may be either from top to bottom or from bottom to top. The invention therefor permits flow reversal, compared to conventional mills that cannot rely on magnetic forces, in addition to flow shear, to provide fluidization.

The mill shown in FIG. 1 has the general configuration of a right circular cylinder, comprising a magnetizable outer shell 10 having rotatable multi-pole magnetic agitator 11 positioned within the shell. The agitator has central shaft 12 and impellers 13 mounted thereon. The shape of the impellers will vary with the overall design of the mill, the degree of shear desired and the intended use of the mill, and may include, for example, fingers and/or discs. Some or all of the fingers or discs may be magnetic. Such discs may be concentrically or eccentrically mounted on the shaft. In general, the impellers should extend to a sufficient diameter such that the annular region (or gap when fingers are used) between the agitator and magnetic outer shell allows a sufficient magnetic field and shear zone in the annulus. If the impeller is made to produce a stronger magnetic field, then larger annulus gaps are possible.

In addition to the media mill 1 itself in FIG. 1, also illustrated is a mechanical rotating means 14 (such as a motor or pneumatic drive) attached to shaft 12. The mill and the rotating means 14 are mounted on a support means 17. The speed of rotation provided by the rotating means 14 to the shaft 12 will vary with the intended use, but will typically range from about 300 to 3000 revolutions per minute. For a 9.5 inch disc impeller, a preferred range is 400 to 900 revolutions per minute. Rotational speeds which provide an impeller tip speed (tip speed equals the revolutions per minute times the circumference) of at least about 1000 feet per minute and more preferably at least about 2000 feet per minute are particularly preferred when the invention is used for pigment dispersion. Generally the higher the impeller tip speed the better. However, after a certain upper speed, too much heat may be generated, or the cost of an increase in speed may not give commensurate performance.

The temperature of the mill is kept at a low level, suitably 90° to 120° F., by circulating a cooling liquid 15, for example chilled water, through a jacket 22 surrounding the mill and monitoring the temperature with thermocouple 20 and thermocouple 21. The cooling liquid is stored in a tank 16 and circulated through a pump 18 and a refrigeration unit 19.

In accordance with the present invention, the media are magnetized, at least during the operation of the mill. The media may be prepared from a wide variety of materials that are magnetizable, that is, exhibit an induced magnetic dipole moment or are permanently magnetized. For example, metals which may be used include iron and iron alloys, as well as Alnico alloys, which typically comprise varying concentrations of aluminum, nickel, cobalt and copper.

The media may also be prepared from ceramic and rare earth materials which exhibit a permanent magnetic dipole moment. Such materials include, for example, those based, in whole or in part, on magnesium oxide, chromium oxide, strontium ferrite, barium ferrite, magnesium ferrite, neodymium, iron boron, neodymium iron boron, samarium cobalt, and those based on zirconium, such as zirconia and zirconium silicates. For the grinding of certain pigments, it may be desirable to use a magnetic media coated with non-magnetic ceramic. In the alternative, ceramic media particles impregnated with a magnetic component may be used, or particles prepared from a substantially homogeneous blend of magnetic and non-magnetic ceramic components may be used.

Still other media which can be used in the present invention are those ferromagnetic resin compositions described in Saito, U.S. Pat. No. 4,462,919, hereby incorporated by reference.

The size and configuration of the media will, of course, vary with the intended application, and spherical as well as elongated shapes can be used. However, spherical media are typically used, on the basis of ready availability and effective media performance. The diameter of spherical media may suitably range from about from 0.1 to 3.0 mm. Preferably, the media will have a size that does not permanently retain magnetization, for ease of cleaning.

The media may comprise a portion which is neither magnetic nor magnetizable, so long as the concentration of such non-magnetic media is not so high as to produce a discrete phase in the mill or interfere with the uniformity of the flow within the mill. In addition, as indicated above, individual media particles may, if desired, comprise both magnetizable and nonmagnetizable material, so long as the overall magnetic character of the media is not impaired.

The concentration of the media in the mill is also important to the overall performance. Specifically, in order to realize the benefits of the magnetization imparted to the media, the particles should be present so as to provide a media volume of at least about 25%. More precisely, the volume of the media particles should be equal to at least about 25% of the combined volume of the media and free space within the container of the mill. In this way, the magnetic force is believed to minimize the distance between the media particles, thereby increasing the grinding efficiency. Preferably, the media volume is at least about 35% and most preferably at least about 60%. In a horizontal mill the volume percent of the media could be even higher.

The magnetization of the media may be accomplished by a wide variety of means. The media may be permanently magnetic, or the media may be magnetized by other components in the apparatus. For example, permanent magnets may be used in or around the central shaft, which may also render the impellers magnetic in the mill. Alternatively, the media may be magnetized by external inducers such as a permanent magnet or an electromagnetic coil exterior to the container of the mill. The permanent magnets in the shaft are suitably placed within non-magnetic or magnetic cups for greater structural strength or to prevent contamination of the material in the mill by abrasion of the magnets.

The magnetic field used to magnetize the grinding media employed in the instant invention can be varying or non-varying with time and can be spatially uniform or non-uniform. As in the embodiments shown in the figures, the field may be uniform to a relatively large extent. Maintaining a sufficient magnetic field over a long media mill length requires the use of multiple magnets.

Substantially spatially non-uniform fields which can be used include, for example, those which vary with time, such as those induced by a pulsed magnetic source; those induced by magnetic fields sinusoidally varying with time; or those induced by rotating permanent magnets. A spatially non-uniform magnetic field can also be provided by a travelling wave magnetic field, using either moving permanent magnets or moving direct current carrying conductors. In the alternative, a travelling wave magnetic field can be generated with no moving parts by using polyphase currents in windings distributed in space. Such an arrangement is typically found in the stator windings of induction or synchronous machines.

Magnetization of the media may be accomplished, as noted above, by the use of magnetic impellers, which impellers are induced magnets. While a variety of materials may be used for the construction of the impellers, metals are generally used for structural integrity and ease of fabrication of the impellers. Such metals are preferably magnetizable, as compared to permanent magnets, although it is possible that magnetizable metals may retain a small amount of permanent magnetism. Suitable magnetizable metals include magnetizable steels, for example tool steels. In addition to the magnetization of impellers and media, it is important that the container (outer shell 10 in FIG. 1) also be magnetizable in order to efficiently complete the magnetic circuit.

The effective level of magnetization of the media may vary widely, depending, for example, on the size, density and loading of the media, the density and viscosity of the fluid in the mill, and the level of agitation within the mill. Any level of magnetization of the media will provide improvement in the grinding performance, up to a point where the media begins to assume a locked configuration, that is, the point at which the media particles begin to move as agglomerates rather than individual particles. At this point, a lessening of the improvement may be observed. In practice, the grinding efficiency improves with magnetization until it reaches a peak, and then depreciates with increasing agglomeration of the magnetized media particles, until the media is in a completely locked configuration at a given rate of flow through the mill.

The particular level of magnetization will, as noted above, vary with the given operating conditions in a mill, and is directly related to magnetic flux density, which is measured in units of Gauss. With highly magnetizable media, the magnetic flux density approximately equals the magnetization of the media as measured in units of Gauss. The magnetic flux density may be measured by a conventional commercially available Gaussmeter. The magnetic flux density is measured by direct contact with the surface of the media, using a Gaussmeter probe under the conditions of magnetization. In the systems tested, little additional milling benefit was realized at magnetic flux densities on the media of greater than about 750 Gauss. Above 1200 Gauss, the media typically began to agglomerate.

Higher magnetization values lead to bed locking where adjacent particles form agglomerates that cannot be broken up by the shear flow. The onset of bed locking may be determined by means of the following formulae. The magnetic moment "m" of a spherical particle of radius "a" and volume "V" with uniform magnetization "M" is $$m = MV = M\,4\pi\frac{a^3}{3}$$

The magnetic force of attraction "fatt" of two adjacent contacting particles so that the distance between centers is twice the radius (2a) is $$f_{att} = \frac{3\mu_o m^2}{2\pi(2a)^4} = \frac{3\mu_o m^2}{32\pi a^4} \quad (1)$$

Where $\mu_o = 4\pi \times 10^{-7}$ Henries/meter is the magnetic permeability of free space.

The approximate drag force, "$f_{drag}$", on a single spherical particle of radius "a" in a flow at velocity v is $$f_{drag} = 6\pi\eta a v \quad (2)$$

where $\eta$ is the fluid viscosity.

Bed locking will onset, approximately speaking, when the magnetic force of attraction in equation (1) just equals the flow shear force in equation (2). The approximate maximum magnetization "$M_{max}$" without bed locking is then $$\mu_o M_{max} = \left[\frac{36\mu_o\eta v}{a}\right]^{\frac{1}{2}} \quad (3)$$

The magnet strength required to produce this magnetization depends on the magnetic susceptibility of the particle. An increase in media particle susceptibility will allow a weaker strength magnet to produce the same media particle magnetization. For example, with a media particle of hardened carbon steel shot, the relative magnetic susceptibility is typically much greater than 1000. For a shaft of 2.25 inch radius rotating at 1400 rpm, the shaft linear speed is about 1.3 meters per second. The effective medium viscosity of a bed of iron particles with diameter 0.8 mm is about 100 centipoise, which is 0.1 newton-second/(meter)$^2$. For these parameter values, the maximum particle magnetization without particle locking as given by equation (3) is about 1200 gauss. Thus the maximum magnetic field from all magnets should also be slightly less than 1200 Gauss for these parameters. Larger shaft rotational speeds and smaller media particles allow larger strength magnets without bed locking. As discussed above, it is desirable to operate the mill as close to media locking as is practical without locking in order to optimize milling efficiency because the effectiveness of the bed generally increases with magnetization (although the closer to bed locking you operate the higher the temperature).

In other embodiments of the present invention, the impellers may be in the form of discs which may be axially or radially magnetized. Each disc may be divided, if desired, into radial sections which alternate in the direction of their radial or axial magnetic field. In this way, the magnetic field outside of the magnetic impeller becomes more non-uniform. Non-uniformities in the magnetic field may have the advantage of increasing inter-particle forces and increasing grinding, although a disadvantage may be that too much heat is generated.

Figure 5:
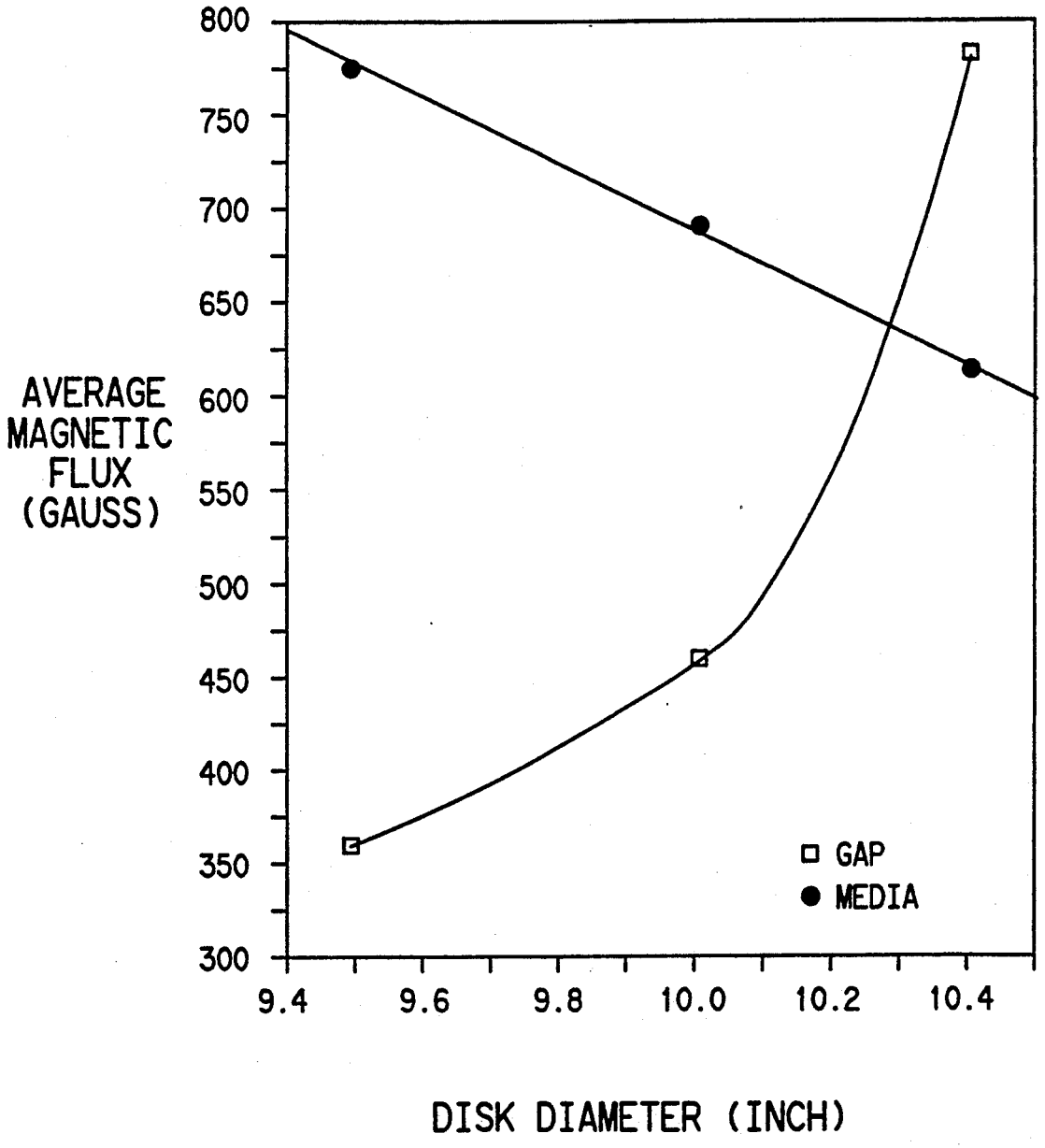
FIG. 5 shows a graph of the average magnetic flux density versus the disc diameter for the media and gap region of the mill.

In one particular embodiment of the present invention, when the magnetization of the media is imparted by uniformly magnetized impellers, each impeller should typically have a magnetic flux density of at least about 50 Gauss, suitably 50 to 1000 Gauss, preferably 300 to 500 Gauss, and more preferably 350 to 450 Gauss. For producing pigmented finishes, the impellers are suitably circular disks on a central shaft. The diameter of the impeller is suitably 2 to 15 inches, preferably about 10 inches. FIG. 5 shows a graph of the calculated magnetic flux (Gauss) versus the disc diameter for the media and the gap region of the mill. Typically, the media mill has at least 3 impellers, suitably 3 to 50, and preferably 5 to 45. Suitably, the impellers have a thickness of about ⅛ to 2 inches, preferably 0.25 to 1 inch, more preferably about 0.5 inch. In order to measure the magnetic strength or magnetic flux density of a single magnet and avoiding the additive effect of several magnetic impellers, the magnetic flux density should be measured on the face of the disc magnet when separated from the mill in free space.

In a preferred embodiment of the present invention, each of a plurality of impellers have a polar charge on its exposed faces that is opposite to the polar charge of the exposed faces of the most adjacent impeller on each side thereof, such that the impellers alternate in polar charge along the shaft. In such an embodiment, each of a plurality of impellers are sandwiched between at least two magnets, suitably magnetic rings, in or around the central shaft. The two magnets have the same polar charges facing each other, such that a magnetic charge is induced in the impeller with which it is in contact. This results in the same polar charge on the top and bottom exposed faces of the impeller not in contact with the magnets. Of course, the media mill may also have additional impellers which are not magnetic or less magnetic. In fact, it may be preferred that the impellers most adjacent to the exit and entrance of the media mill not be in contact with a magnet on the face of the impeller adjacent the exit or entrance, since otherwise an asymmetric end point may cause dynamic instability and vibrating in the shaft.

In the preferred embodiment, the disc shaped impellers have a chamfered, semi-circular, or bullet shaped radial edge, in axial cross-section. Such a shape produces a more uniform magnetic field in the media. It was found that sharp edges or corners tend to have a concentrated polar charge and thereby produce localized regions of strong magnetic fields which may have an adverse effect on the milling, for example, such non-uniformities may prevent the media from being distributed evenly in the gap and annular region of the mill.

As indicated above, it is preferred that a plurality of impellers along the central shaft are configured such that the polar charges of the exposed face of the impellers alternate along the shaft and opposite magnetic polar charges face each other between adjacent impellers. However, it is optional to alternately have a plurality of impellers along the central shaft which are configured such that the polar charges of the exposed faces of the impellers are the same and like magnetic polar charges face each other between adjacent impellers.

As indicated above, the particular shape of each impeller is not critical, and various designs, known in the art of mixing, may be followed in constructing or machining an impeller. For example, instead of discs, the impellers may comprise fingers, since fingers become like a disc at sufficiently high speeds. Alternatively, an impeller may consist of fingers coming out of a disc. Optionally, there may be waves in a disc or orifices of various shapes in the disc. Other suitable designs for impellers include a clover leaf design or a square with rounded corners. A plain disc design, with rounded radial faces, produces a relatively uniform magnetic field.

Some of the magnets along the shaft may be separated by a non-magnetizable spacer. Such a spacer is made of a non-magnetizable material such as machined stainless steel or plastic, for example nylon or TEFLON fluoropolymer. Such a spacer serves to moderate the strength of the magnetic charge induced in the impellers by permanent magnets. In one possible configuration in the media mill, a spacer is located between two adjacent impellers. In this case, the spacer is located between two permanent magnets whose facing sides have opposite polar charges.

Figure 2:
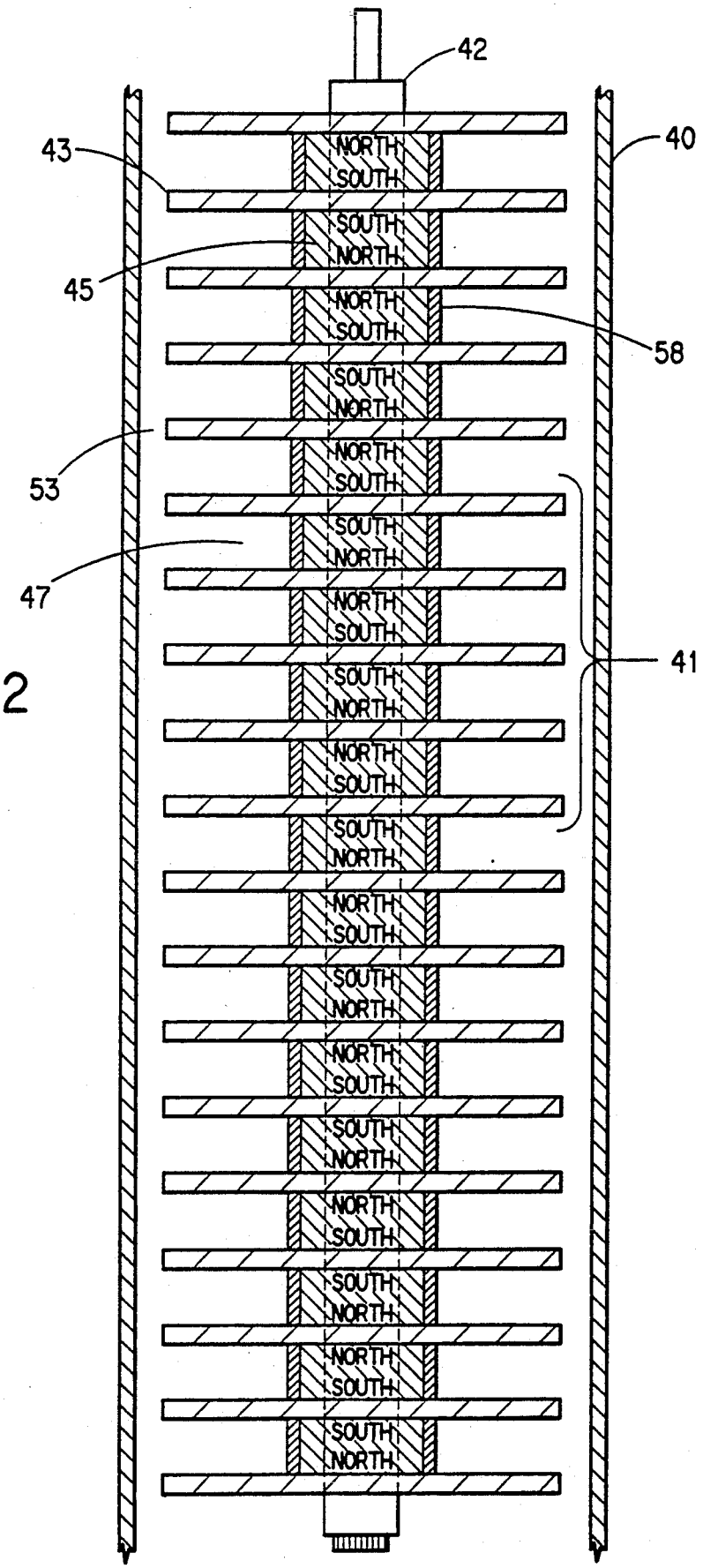
FIG. 2 shows a cross-section of one embodiment of a media mill according to the present invention.

One embodiment of a media mill employed in the present invention may be more fully understood by reference to FIG. 2, in which a cross sectional representation of a magnetic media mill is shown. The mill comprises a magnetizable outer shell 40 having a rotatable multi-polar agitator 41 positioned within the shell. The agitator 41 has central shaft 42 and magnetic collars or rings 45, for example, a commonly available ceramic ring magnet. The exposed surface of each magnet may be covered with a non-magnetizable sleeve or coverplate 58, for example of an INCONEL alloy material, to prevent contact of the product being milled. Concentrically mounted on the shaft are impeller discs 43. In this embodiment, each of the discs 43 are placed between two permanent magnetic rings 45 with like magnetic poles facing each other. In other words, each impeller disc 43 is mounted in such a way that the magnet faces of each adjacent magnetic ring would repel each other, except that they induce a magnetic field in the intervening impeller. As evident in the Figure, the impellers 43 have a larger outer diameter (OD) than the magnetic rings 45 on the shaft, and hence define an annular space referred to as the "media region" 47 between the faces of adjacent impellers and radially limited by the impeller diameter. A cylindrical space, referred to as the "gap region" 53, extends along the length of the media mill between the radial sides of the impellers and the opposite inner surface of the shell 40. In general, the disc impeller 43 will extend to a diameter that results in a sufficient magnetic field and shear zone in the annulus and gap.

Figure 3:
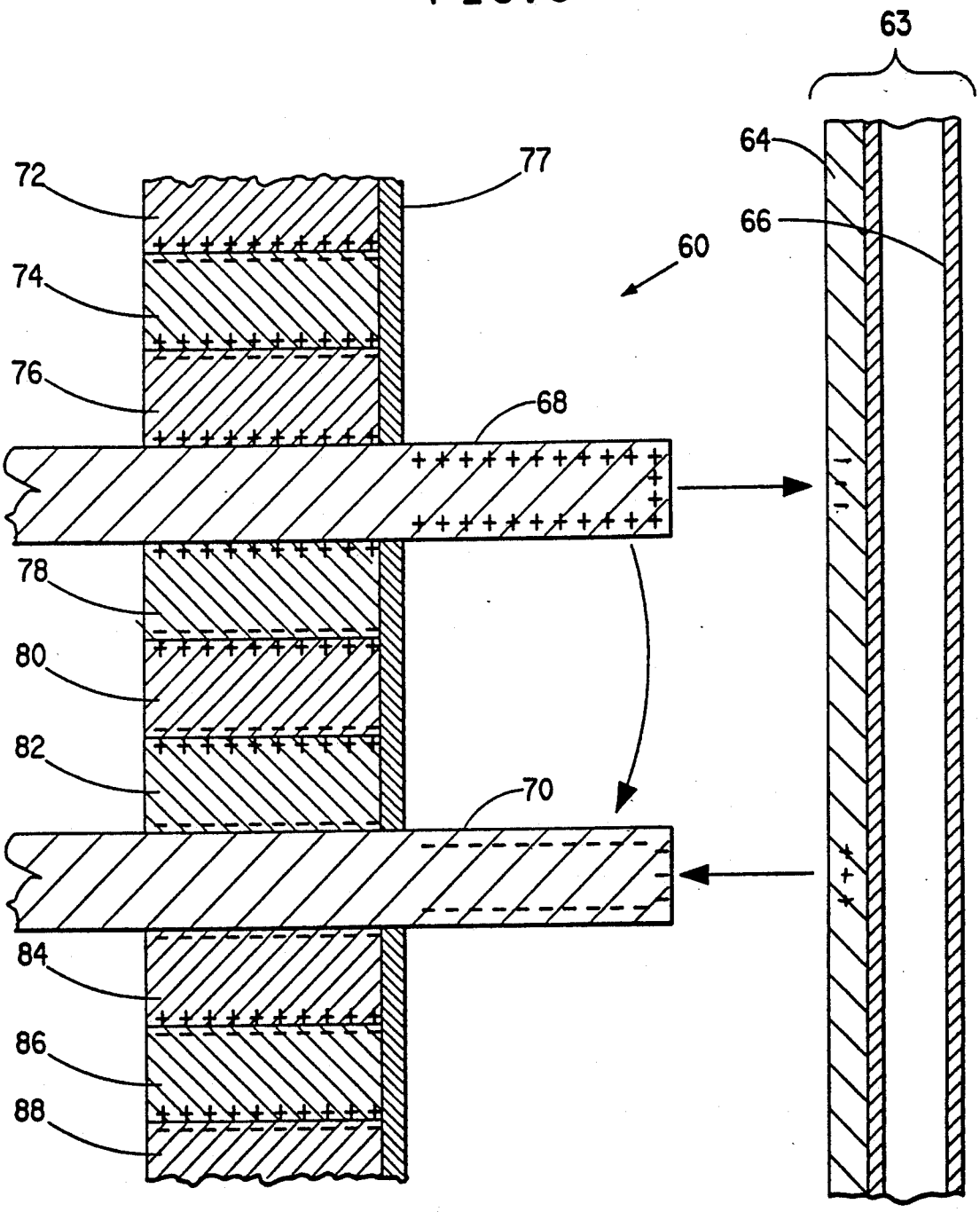
FIG. 3 shows a cross-section of another embodiment of the present invention with three permanent magnets placed between adjacent impellers.

Referring now to the embodiment in FIG. 3, a portion of a multi-polar rotating agitator 60 is shown within a magnetizable shell 63 comprising a magnetizable steel wall 64 surrounded by a shell 66 for cooling water. Impellers 68 and 70 are shown with the magnetic polar charges on their exposed surfaces. As evident, the upper disc is positively charged and the lower adjacent disc is negatively charged on the exposed sides not in contact with the magnets. Such charges on the discs are induced by the magnetic rings 72, 74 and 76, 78, 80, 82, 84, 86, and 88 which are surrounded by protective cover 77 which may be magnetizable or non-magnetizable. The magnetic charges on the faces of the magnetic rings 72 to 88 are also shown. As evident, the magnets adjacent the impellers have the same charge facing each other.

Referring now to the embodiment in FIG. 4, again a portion of a multi-polar rotating agitator 90 is shown within a magnetizable shell 92 comprising a steel wall 94 surrounded by a shell 96 for cooling water. Impellers 98 and 100 are shown with the magnetic polar charges on their exposed surfaces. Again, the upper disc is positively charged and the lower adjacent disc is negatively charged, that is the charges of the impellers alternate along the shaft. Such charges on the discs are induced by the magnetic rings 102, 104, 106, 108, 110, and 112. Between magnets are non-magnetizable spacers 114, 116, and 118 to help moderate the magnetic field strength in the media. The magnets and spacers surrounded by a protective cover 120. The magnetic charges on the faces of the magnetic rings 102 to 112 are also shown. Again, the magnets adjacent the impellers have the same charge facing each other.

Figure 4:
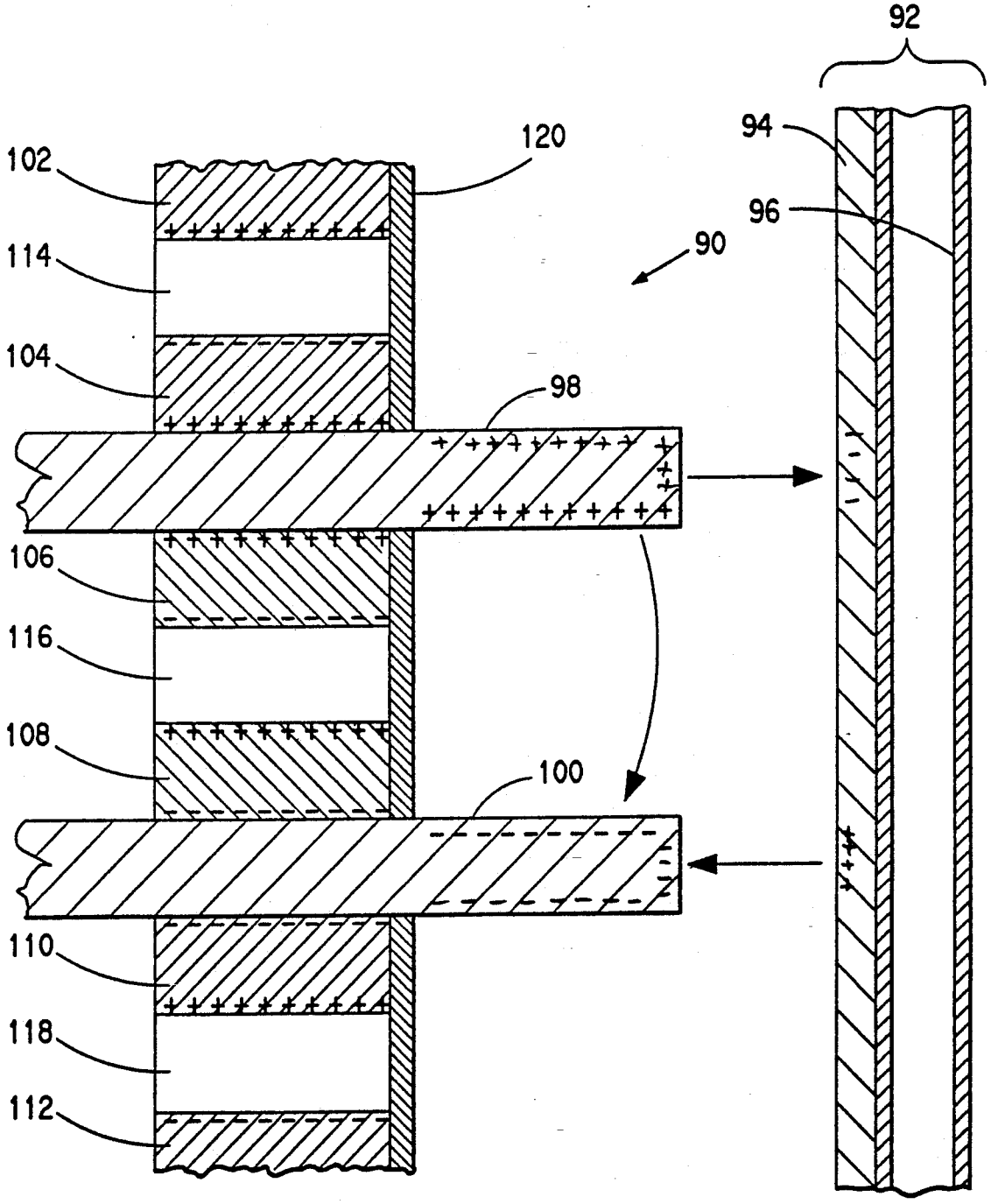
FIG. 4 shows a cross-section of another embodiment of the present invention with a non-magnetizable spacer placed between two permanent magnetic rings placed along the central shaft between adjacent impellers.

Configurations of magnets and spacers may be vary from that shown in FIGS. 2, 3 and 4. For example, the reverse sequence of FIG. 4 may be employed, wherein a single magnet is placed between two spacers, the latter in contact with the impellers. The sequences may be repeated between impellers. For example between impeller disks, the following sequence may occur: first spacer, first magnet, second spacer, second magnet, third spacer, third magnet, and fourth spacer.

It will also be apparent to those skilled in the art that the thickness of the spacers and magnets may vary and differ along the shaft, such that the desired magnetic fluxes are produced, the spacers serving to moderate the fluxes produced by the magnets.

The present invention provides a process of media milling that permits easy fluidization of the media, which is less dependent on flow rate and media load, and provides faster and more efficient milling performance than has heretofore been attainable with conventional media mills.

The present process has numerous applications, as is apparent to those familiar with the conventional uses of media mills. For example, the present process can be used to disperse a wide variety of powders, pigments, precipitates or other solids in a liquid carrier. Such pigments may be employed for providing color or pigmenting coatings, paints, varnishes, automotive finishes, and the like. Materials that can be dispersed according to the present invention also include inks, various foods, e.g., peanut butter, and magnetic particles for video and audio tapes, to name a few.

The present invention is further illustrated by the following specific examples. These examples are provided for the purpose of illustration and are not intended in any way to limit the breadth of the invention.

EXAMPLES

In Example 1-3, an open head (atmospheric) media mill having a chamber diameter of 4 inches and length of 9 inches was mounted so that an interchangeable shaft could be positioned in the carbon steel shell and attached to a motor drive. Various induced magnetic discs were assembled using configurations similar to that shown in FIG. 2 and described in more detail in each of Examples 1-3 below. In these particular examples, the induced magnetic discs are solid magnetizable steel magnetized with ceramic ring magnets in contact with the discs.

The particle size of the dispersion (i.e., grinding efficiency) was characterized by a measurement of relative transparency of a film drawdown on a glass plate compared to a standard drawdown made from the standard control nonmagnetic process. The relative transparency was measured on a Hunter "Color Quest" spectrophotometer.

EXAMPLE 1

Magnetization was provided by the use of induced magnetic steel discs in contact with ceramic ring magnets. The discs were arranged similarly to those shown in FIG. 2. The ceramic ring magnets were 0.375 inch thick strontium ferrite permanent magnetic ceramic rings having an outer diameter of 1.4 inches and an inner diameter of 0.875 inch (available from Job Master Magnets). Nineteen, 0.1 inch thick discs having a diameter of 3.0 inches were used with an alternating pole arrangement from disc to disc. The spacing between each disc was 0.375 inch (or one magnet thickness). The magnets were oriented so that the north pole on one face of the disc faced the north pole on the other face of the disc. The adjacent disc was oriented so that the south pole of the magnet on the face of the disc faced the south pole of the magnet on the other face, and so on. The annulus between the induced magnetic steel discs and the wall of the mill was 0.5 inch.

Figure 6:
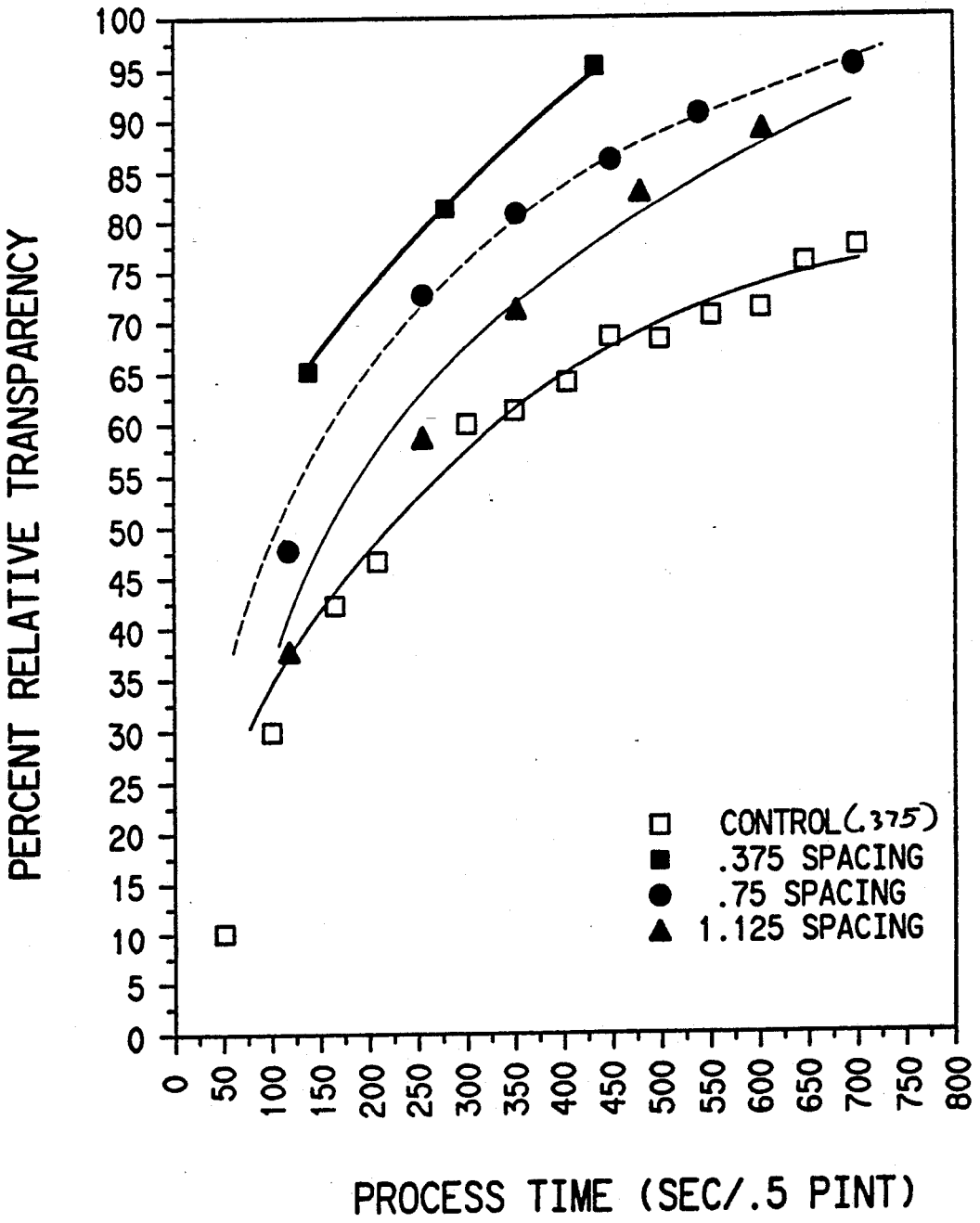
FIG. 6 shows a graphical representation of the performance of a media mill vs. a non-magnetic media mill from Examples 1 to 3.

The mill was filled with 5,900 grams of 0.8 mm spherical steel media, and operated at 1680 revolutions per minute. Cooling water was supplied to the outer shell of the mill to control batch temperature during grinding to about 150° F. In this example 3 gallons of pigment dispersion of Perrindo Maroon pigment (R6434) manufactured by Mobey Chemical Co. (the composition of the Perrindo Maroon Pigment premix is shown below in Table 1) was prepared by passing the premix through the magnetic media mill. Similarly, as a control, an identical premix was passed through a similar set of non-magnetic discs to compare magnetic effects. The results are shown in FIG. 6 together with the results of Examples 2 and 3 below. This figure plots the % Relative Transparency of the pigment dispersion versus the processing time. (Processing time represents the amount of time the pigment dispersion is processed through the media mill.)

TABLE 1

| Perrindo Maroon Pigment Dispersion | |
|---|---|
| | Weight % |
| Butyl Acetate | 30.55 |
| Acrylic Resin | 29.25 |
| Xylene | 12.54 |
| Acrylic Dispersing Resin | 2.34 |
| Toluene | 1.92 |
| Perrendo Maroon Pigment | 23.40 |
| Total | 100.00 |

EXAMPLE 2

This example incorporates exactly the same equipment, and dispersion as described in Example 1, except ten induced magnetic steel discs were spaced 0.75 inch apart (two 0.375 inch magnets thick) and 7,000 grams of 0.8 mm spherical steel media was used. The batch temperature was between 105° and 125° F. Comparison of this design versus Example 1 is shown in FIG. 6 together with the results of Example 1 and 3.

EXAMPLE 3

This example incorporates the same equipment, dispersion and grinding media described in Example 2, except a larger spacing of 1.125 inch (three 0.375 inch magnets) induced magnetizeable discs was used and it was run at between 85° to 105° F. In each of the Examples 1-3, the cooling water temperature and flow rate was held constant, so that batch temperature gave an indication of the energy input for the different magnetic intensified mill designs. The non-magnetic mill batch temperature was between 80° and 90° F. Comparison of the magnetic intensified design versus Examples 1 and 2 designs using the same premix is shown in FIG. 6. Examples 1 and 2 designs using the same premix is shown in FIG. 6.

EXAMPLE 4

Figure 7:
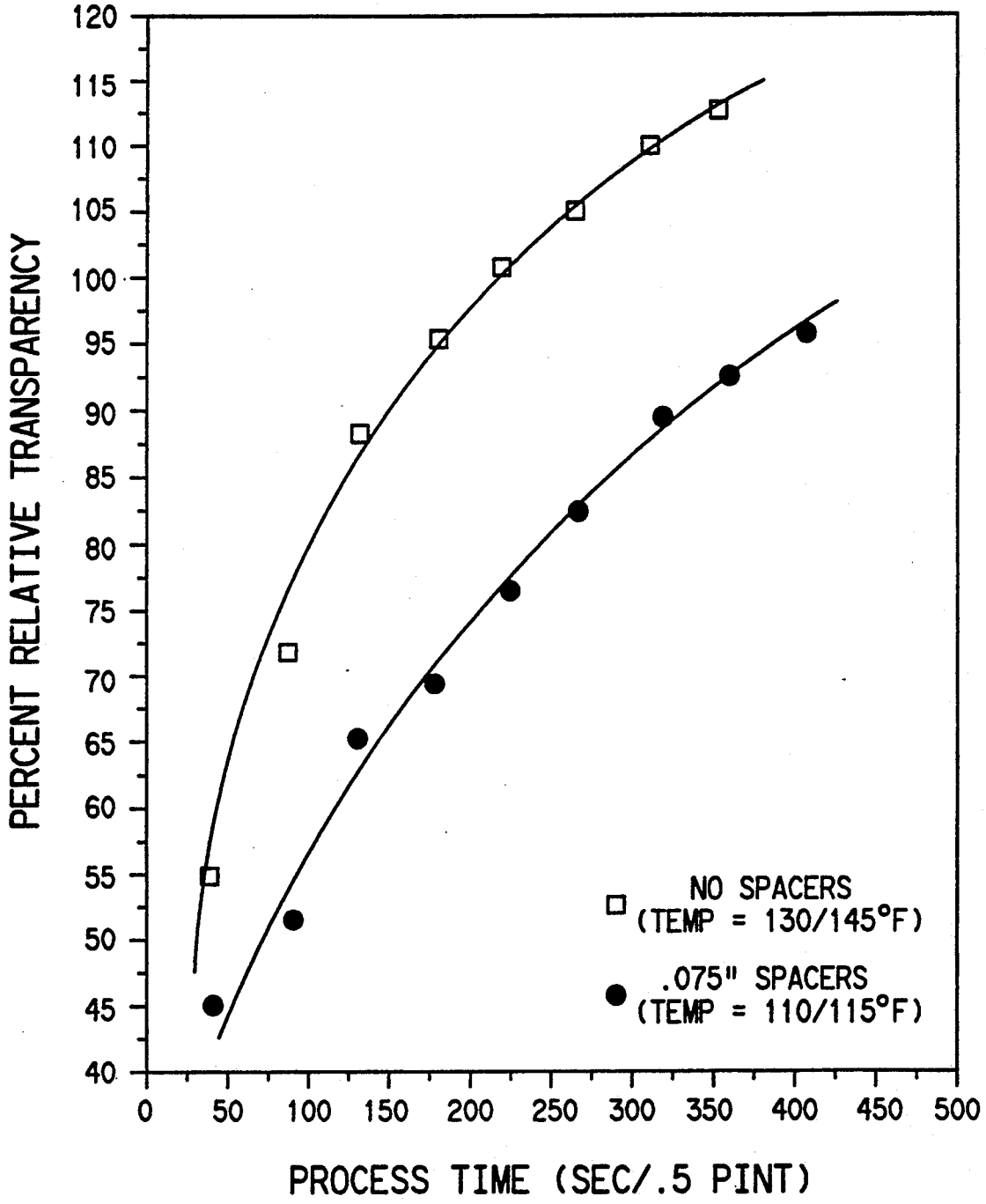
FIG. 7 shows a graphical representation of the performance of a magnetic media mill without spacers vs. a magnetic media mill with spacers from Example 4.

This example incorporates the same equipment and grinding media as described in Example 1, except fifteen discs, 0.1 inch thick, having a diameter of 3.0 inches were used with a spacing of 0.525 inch which consisted of a 0.375 inch thick magnet sandwiched between two non-magnetizable stainless steel "tuning" spaces, each having a thickness of 0.075 inch. The magnets were oriented the same as Example 1 with the same magnetic poles on either side of each disc facing each other, alternating north, then south, etc. In this example, a Perrindo Maroon pigment (R6434) manufactured by Mobay Chemical Co. (the composition of the Perrindo Maroon Pigment premix is shown below in Table 2) was prepared by passing the premix through the magnetic media mill equiped with spacers. Similarly, an identical premix was passed through a magnetic set of discs described in Example 1 without "tuning" spacers. The results are shown in FIG. 7.

TABLE 2

| | Weight % |
|---|---|
| Butyl Acetate | 24.98 |
| Acrylic Resin | 31.67 |
| Xylene | 12.45 |
| Acrylic Dispersing Resin | 9.90 |
| Perrindo Maroon Pigment | 21.00 |
| Total | 100.00 |

EXAMPLE 5

In this example, 230 gallons of pigment dispersion of Perrindo Maroon pigment (R6434 manufactured by Mobay Chemical Co.) was prepared, at a rate of 6.4 pounds per minute, by passing the composition through a 25 gallon Schold shot mill, having a magnetizable carbon steel shell manufactured by Schold Machine Co., and modified to incorporate the concept of magnetic intensified grinding. The standard ten disc assembly supplied by Schold Machine Co. was replaced by a magnetic disc assembly operating at 420 revolutions per minute on ½ normal tip speed for a standard Schold mill. Twenty-one (magnetizable) solid tool steel disks were used having 9.6 inches diameter and 0.4 inch thick, spaced 1.5 inch apart. The spacing was provided by ceramic ring magnets having a 5.25 inch outer diameter and 2.3 inch inner diameter and 1.5 inch thickness (this is available from General Magnetics, Inc. of Dallas, Texas as two 0.75 inch thick magnets). A media load of 440 pounds of standard 0.8 mm steel shot was used versus a load of 500 pounds for a standard 25 gallon Schold Mill. Finished product transparency quality was attained faster with the magnetic intensified mill giving a 1.8 times higher productivity rate on this basis. The standard non-magnetic Schold mill produced finished pigment dispersion in 14 passes at 10 pounds per minute versus the higher productivity magnetic mill producing finished quality in 5 passes at 6.4 pounds per minute.

Various modifications, alterations, additions, or substitutions of the parts of this invention, without departing form the scope and spirit of the invention, will be apparent to those skilled in the art. This invention is therefore not limited to the illustrative embodiments set forth herein, but rather the invention is defined by the following claims.

We claim:

1. A media mill comprising a magnetizable container; a rotatable multi-polar magnetic agitator within the magnetizable container, the multi-polar magnetic agitator having a central shaft and a plurality of magnetic impellers on the shaft; and magnetizable media within the container, wherein the media particles are present in such quantity as to provide a media volume of at least about 25% and are sufficiently magnetized by the magnetic agitator so that the grinding efficiency is improved, the improvement being characterized by each of said impellers being sandwiched between at least two permanent magnets along the central shaft, wherein said two magnets have the same polar charge facing each other, such that a magnetic charge is induced in said each impeller, which results in the same polar charge on most of the surface area of the top, bottom, and side exposed faces of the impeller not in contact with the magnets.

2. The media mill of claim 1, wherein the media mill further comprises impellers which are not magnetic.

3. The media mill of claim 2, wherein the number of impellers in the media mill ranges from 3 to 50.

4. The media mill of claim 1, wherein said impellers are substantially disc shaped.

5. The media mill of claim 4, wherein at least one of said impellers has a chamfered radial edge, in axial cross-section.

6. The media mill of claim 4, wherein at least one of said impellers has a circular radial edge, in axial cross-section.

7. The media mill of claim 1, wherein the diameter of the impeller ranges from 3 to 20 inches.

8. The media mill of claim 1, wherein the flux density on the surface of the impeller ranges from 50 to 1000 Gauss.

9. The media mill of claim 8, wherein the flux density ranges from 300 to 500 Gauss.

10. The media mill of claim 1, wherein the polar charge on the exposed faces of a first of the impellers is opposite to the polar charge on the exposed faces of each of the two adjacent impellers, whether the adjacent impellers are upper and lower or left and right depending on whether the mill is vertically or horizontally disposed.

11. The media mill of claim 10, wherein a plurality of impellers along the central shaft are configured such that the polar charge of the exposed faces of each of the impellers alternate along the shaft, and, for adjacent impellers, opposite magnetic polar charges face each other.

12. The media mill of claim 1, further comprising an impeller most adjacent to the exit and entrance of the media mill wherein the face adjacent the exit and entrance is not in contact with a magnet.

13. The media mill of claim 1, wherein at least two magnets along the shaft are separated by a spacer which moderates the magnetic field strength in the media.

14. The media mill of claim 13, wherein at least one spacer is located between at least two adjacent impellers.

15. The media mill of claim 13, wherein a spacer is located between two permanent magnets whose facing sides have opposite polar charges.

16. A media mill comprising a magnetizable container; a rotatable multi-polar magnetic agitator within the magnetizable container, the multi-polar magnetic agitator having a central shaft and a plurality of magnetic impellers on the shaft; and magnetizable media within the container, wherein the media particles are present in such quantity as to provide a media volume of at least about 25% and are sufficiently magnetized by the magnetic agitator so that the grinding efficiency is improved, the improvement being characterized by each of said impellers being sandwiched between at least two permanent magnets, wherein said two magnets have the same polar charge facing each other, such that a magnetic charge is induced in said each impeller, which results in the same polar charge on substantially all of the top, bottom, and side exposed faces of the impeller not in contact with the magnets and wherein said plurality of impellers along the central shaft are configured such that the polar charge on the exposed faces of at least one of said impellers is opposite to the polar charge on the exposed faces of each of the two adjacent impellers, and wherein said plurality of impellers along the central shaft are configured such that the polar charge of the exposed faces of each of the impellers alternate along the shaft.

* * * * *